US009840348B2

(12) United States Patent
Saliaris

(10) Patent No.: US 9,840,348 B2
(45) Date of Patent: Dec. 12, 2017

(54) MODULAR PALLET

(71) Applicant: Daniel P. Saliaris, Delaware, OH (US)

(72) Inventor: Daniel P. Saliaris, Delaware, OH (US)

( * ) Notice: Subject to any disclaimer, the term of this patent is extended or adjusted under 35 U.S.C. 154(b) by 0 days.

(21) Appl. No.: 15/406,888

(22) Filed: Jan. 16, 2017

(65) Prior Publication Data

US 2017/0210506 A1 Jul. 27, 2017

Related U.S. Application Data

(60) Provisional application No. 62/281,824, filed on Jan. 22, 2016.

(51) Int. Cl.

| | |
|---|---|
| ***B65D 88/00*** | (2006.01) |
| ***B65D 19/00*** | (2006.01) |
| ***B65D 19/38*** | (2006.01) |
| ***B65D 19/44*** | (2006.01) |
| ***B65D 85/66*** | (2006.01) |

(52) U.S. Cl.

CPC ..... *B65D 19/0095* (2013.01); *B65D 19/38* (2013.01); *B65D 19/44* (2013.01); *B65D 85/66* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/00273* (2013.01); *B65D 2519/00293* (2013.01); *B65D 2519/00323* (2013.01); *B65D 2519/00333* (2013.01); *B65D 2519/00407* (2013.01); *B65D 2519/00412* (2013.01); *B65D 2519/00572* (2013.01); *B65D 2519/00766* (2013.01); *B65D 2519/00815* (2013.01); *B65D 2519/00985* (2013.01)

(58) Field of Classification Search

CPC ..... B65D 19/44

USPC ..... 108/51.11, 57.13, 57.17, 57.19, 55.3, 108/56.1, 56.3, 57.25, 901, 902

See application file for complete search history.

(56) References Cited

U.S. PATENT DOCUMENTS

| | | | | |
|---|---|---|---|---|
| 2,520,221 A * | 8/1950 | Ponty | E04B 1/6179 403/314 |
| 3,753,407 A * | 8/1973 | Tilseth | B65D 19/44 108/53.3 |
| 5,333,555 A * | 8/1994 | McPhee | B65D 19/0095 108/56.1 |
| 6,231,284 B1 * | 5/2001 | Kordel | B65D 19/44 108/55.3 |
| 8,006,629 B2 * | 8/2011 | Naidu | B65D 19/0038 108/56.3 |
| 8,286,563 B2 * | 10/2012 | Low | B65D 19/0093 108/56.3 |

(Continued)

*Primary Examiner* — Matthew W Ing

(74) *Attorney, Agent, or Firm* — Jason H. Foster; Kremblas & Foster

(57) ABSTRACT

A cargo pallet having parallel, spaced runners with parallel, spaced slats mounted transverse thereto by removable pins. Each of the slats is substantially identical and each has different opposing faces so that when the slats are reversed the different faces provide different cargo-supporting surfaces. There are slat grooves on the runners into which the slats are mounted, along with endwalls, to prevent something from extending between the slats and the runners to separate slats and runners. Blockers extend laterally from one or both sides of the slats to prevent a forklift from contacting the cargo, and when the slats are reversed the blockers interlace.

20 Claims, 18 Drawing Sheets

(56) References Cited

U.S. PATENT DOCUMENTS

| | | | | |
|---|---|---|---|---|
| 9,193,499 | B2 * | 11/2015 | Jordan | B65D 19/0012 |
| 2006/0096508 | A1 * | 5/2006 | Herring | B65D 19/0095<br>108/54.1 |
| 2013/0160680 | A1 * | 6/2013 | Ten Bok | B29C 44/0407<br>108/50.11 |

* cited by examiner

MODULAR PALLET

CROSS-REFERENCES TO RELATED APPLICATIONS

This application claims the benefit of U.S. Provisional Application No. 62/281,824 filed Jan. 22, 2016. This prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to devices used in packaging, storing and transporting, and more specifically to a modular pallet for packaging, storing and transporting items with shapes that inhibit them from being readily stacked.

It is known in the transporting/shipping industry that an apparatus should be used to retain cargo for stability and ease in movement before, during, and after shipping. The generic category for such an apparatus is a "pallet" or a "skid". A pallet is formed from a plurality of perpendicular members stacked and attached in such a way to permit a forklift (also called a lift truck, a fork truck, or a forklift truck) to lift and manipulate them. A pallet is used to elevate one or more objects (herein referred to as "cargo") above a surface on which the pallet rests. A forklift has horizontal forks extending from the front of the forklift that extend into voids formed under a pallet and its cargo to enable the forklift to transport the pallet short distances, such as within a warehouse, dock, semi-trailer or any other enclosure or area.

Cargo is placed on a pallet and commonly secured to the pallet to prevent movement of the cargo relative to the pallet during transportation. An example of cargo that is commonly stacked on a pallet is parallelepiped boxes. Identical boxes may be stacked neatly on the top of a pallet and attached to the pallet by single-use straps made of plastic or metal, tacky polymer sheeting commonly referred to as "shrink wrap", or any other fastener. Conventional pallets work well for a plurality of identical or even dissimilar boxes that stack well and pack tightly because they tend not to shift during transit. It is more difficult to attach spherical, circular cylindrical or oddly-shaped cargo to pallets. For example, if someone wishes to ship multiple cylindrical grinding wheels, as shown in FIG. 1, such wheels are typically placed with their curved sides between two substantially identical and parallel slats of a conventional pallet, and straps are fixed around the cargo. This provides little resistance to rolling or other shifting of the heavy grinding wheels relative to the pallet, and only works when the space in the pallet can accommodate the cargo.

There is a need for a pallet that accommodates various sizes of spherical, circular cylindrical and oddly-shaped objects, and enables stable attachment of such objects to the pallet.

BRIEF SUMMARY OF THE INVENTION

Disclosed herein is an apparatus that is used to retain cargo for stability and ease in movement before, during, and after shipping. The generic category for the apparatus is referred to as "pallets" or sometimes "skids". A preferred pallet has a first runner, a second runner spaced from, and substantial parallel to, the first runner, and preferably a third runner spaced from, and substantially parallel to, the first and second runners. A first slat is removably mounted to the runners and a second slat is removably mounted to the runners with a gap between the first and second slats. The first slat has a first cargo-supporting face on a first side and a second cargo-supporting face on an opposite, second side, and the second slat has a first cargo-supporting face on a first side and a second cargo-supporting face on an opposite, second side.

When the slats are mounted to the runners with the slats' first faces facing one another, the slats' first faces form a first pair of cargo-receiving surfaces. When the slats are mounted to the runners with the slats' second faces facing one another, the slats' second faces form a second pair of cargo-receiving surfaces. The first pair of cargo-receiving surfaces contacts the cargo differently than the second pair of cargo-receiving surfaces, such as at different points, or by contacting different quantities of surface area, or both.

In a preferred pallet, the runners have slat grooves formed therein to receive contacting portions of the slats. Protective endwalls are preferably formed in the slat grooves formed in the end runners, and the endwalls extend over at least a portion of the first and second slats' ends. The slat grooves and the endwalls prevent, or reduce the probability of, any structure, such as a forklift fork, being inserted between the slats and the runners. The pallet preferably comprises removable pins extending through aligned apertures formed through the slats and through the slat grooves formed in the runners. The pins preferably have a first head at a first end of a narrower shaft and a second head at an opposite, second end of the shaft. A slot is formed in the first head that permits the first head to compress and expand back to its original position, thereby permitting one end of the pins to be inserted into a smaller aperture.

The apertures formed through the slats and through the slat grooves formed in the runners are centrally disposed in the slats and the slat grooves. This permits the slats to be positioned in the slat grooves in either of two orientations with the apertures in the slats aligned in corresponding apertures in the runners. Such a structural configuration permits the slats to be reversed and positioned in the slat grooves in either of two orientations.

In an alternative embodiment, at least one of the slats has a blocker extending laterally therefrom to reduce contact between the cargo on the pallet and a device used to lift and manipulate the cargo, such as a forklift. By including a blocker on the slat or slats, a forklift raising the pallet from one side or the other may not impact the cargo, but instead impacts the blocker first. In order to have blockers that extend far enough laterally, but that also may be turned inwardly when not in use, the blockers on facing slats may be interlaced, such as by having peaks and valleys into which peaks of facing blockers are inserted.

Also disclosed herein is a method of constructing a pallet to support cargo that has an outer surface. The method comprises taking a pallet comprising first, second and third runners and first and second slats mounted thereto, and removing at least the first slat. The second runner is spaced from, and substantially parallel to, the first runner, and the third runner is spaced from, and substantially parallel to, the first and second runners. The first elongated slat is removably mounted to the runners in a first series of aligned slat grooves formed in the runners. The first slat has a first cargo-supporting face on a first side and a second cargo-supporting face on an opposite, second side. The second elongated slat is removably mounted, with a gap between the slats, to the runners in a second series of aligned slat grooves formed in the runners. The second slat has a first cargo-supporting face on a first side and a second cargo-supporting face on an opposite, second side. The first cargo-supporting face of the first slat faces the first cargo-supporting face of the second slat. The step of removing includes removing at least the first of the slats from the runners and mounting the first of the slats to the runners in the slat grooves with the second cargo-supporting face of the first slat facing the second slat. This is a reversal of the orientation of at least one of the slats so that the best arrangement of cargo-supporting faces can be selected. Both slats may be reversed, or the best combination of the two cargo-supporting faces can be constructed by simply orientating the slats in the best configuration. This method also contemplates repair of the pallet.

Figure 1:
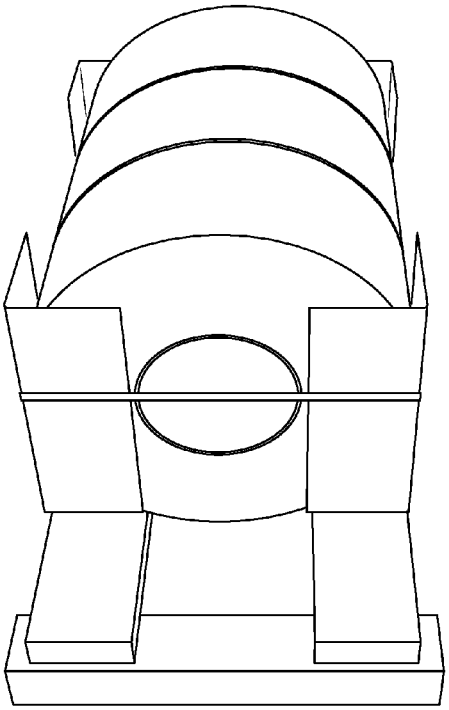
Fig. 1 (PRIOR ART)
FIG. 1 is a view in perspective illustrating a prior art pallet with circular cylindrical objects resting thereon.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 62/281,824 filed Jan. 22, 2016, which is the above claimed priority application, is hereby incorporated by reference.

Figure 2:
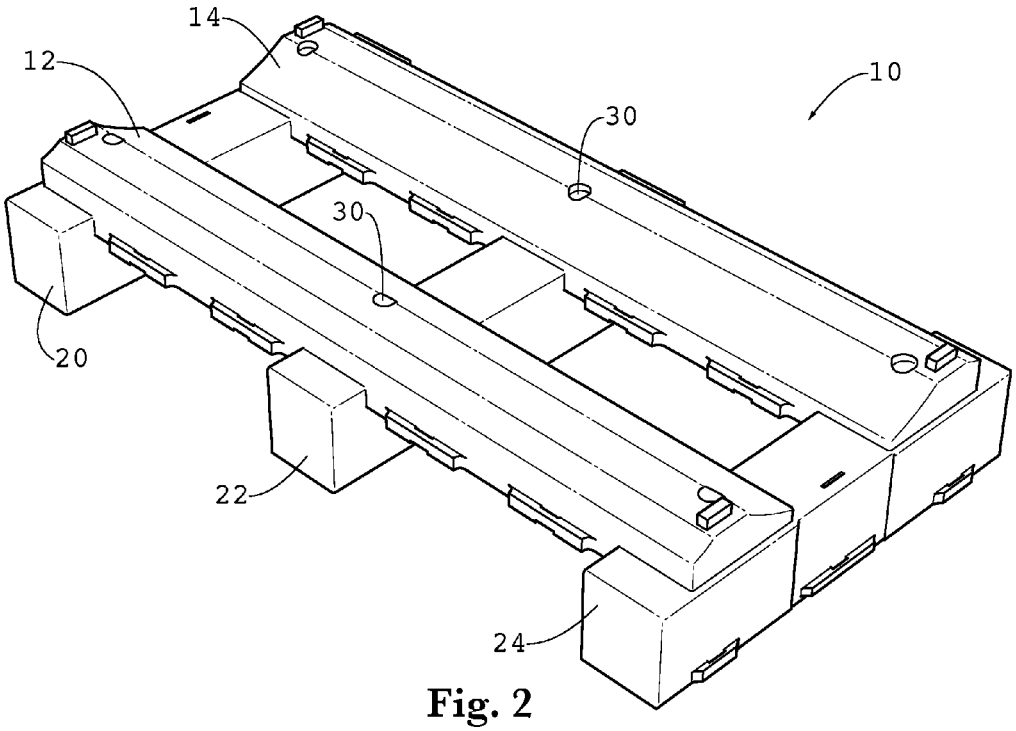
FIG. 2 is a view in perspective illustrating an embodiment of the present invention.

A modular pallet 10 is shown in FIG. 2 made in accordance with the present invention. The pallet 10 has two slats 12 and 14 supported by three runners 20, 22, and 24. An analogous component for a slat in a conventional pallet may be called a "deckboard", and an analogous component for a runner in a conventional pallet may be called a "bearer". The slats 12 and 14 are substantially perpendicularly mounted to the runners 20-24 in an operable position, as shown in FIG. 2, and this creates a configuration that may be useful to receive, store and transport objects that are not readily stacked. The slats 12 and 14 may not be exactly perpendicular, but a transverse orientation that is within typical pallet tolerances is acceptable.

There are multiple pins 30 used in the pallet 10 to attach the slats 12 and 14 to the runners 20-24. Each pin 30 extends through a bore that has a similar, but larger, cylindrical shape to the exterior of the pin 30. Such bores are formed in one of the slats 12-14 and a similarly-shaped bore is formed in one of the runners 20-24. The cooperation between the pins 30 and the structure that defines the bores allows the pins 30 to attach each of the slats 12 and 14 to the underlying runners 20-24 where the substantially perpendicular components intersect as shown in FIG. 2. The pins 30 are preferably made of durable plastic, as are most or all components of the pallet 10, unless stated otherwise.

Figure 28:
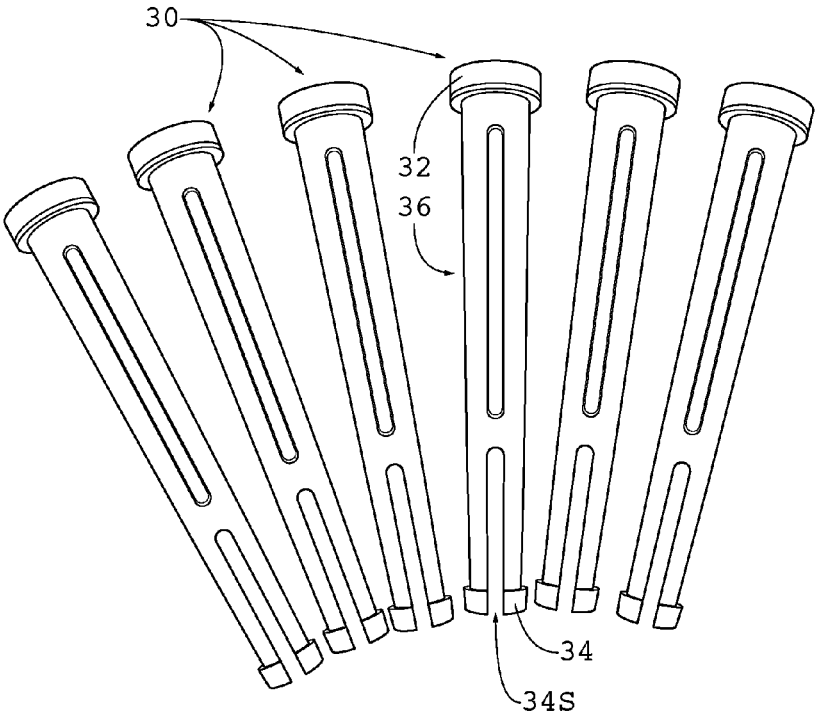
FIG. 28 is a side view illustrating numerous pins used in the present invention.

As shown in FIG. 28, the pins 30 preferably have a first head 32 on a shaft 36, in the manner of a nail, and a second head 34 on an opposite shaft end. The shaft 36 connects the two heads 32 and 34. A slot 34*s* is formed through the head 34, and permits the two spaced fingers formed on opposite sides of the slot 34*s* to compress inwardly under a radial force and expand outwardly upon release of that force.

Attachment of one of the pins 30 occurs by compressing the fingers towards the slot 34*s* and inserting the compressed head 34 into the exposed aperture of a bore, which aperture is smaller than either head 32 or 34 (when the head 34 is expanded). Compression of the head 34 allows the pin 30 to be inserted through the smaller aperture until the head 32 is about to seat against the structure at the end of the bore. The length of the bore is slightly shorter than the length of the shaft 36 so that, just before the head 32 seats, the head 34 exits the opposite end of the bore into which the pin 30 is inserted, and the fingers expand away from one another. Thus, the head 32 and the slotted head 34 function in the manner of a nail or bolt head to prevent removal of the pin 30 without first compressing the fingers on opposite sides of the slot 34*s*.

An advantage of using the pins 30 on the pallet 10 is that if one or more components of the pallet 10 are damaged or need to be separated from one another for any reason, one need merely remove the associated pin or pins 30, and the slat and/or runner may be readily separated and replaced. Removal of the pins 30 is effected by simply compressing the fingers at the head 34 and pushing the pin 30 through the bore in the direction opposite of that in which it was inserted until the pin 30 is entirely removed from the bore. The removed pin or pins 30 may be re-used due to the fact that compressing the fingers on the slotted end 34 does not damage or severely wear the pin 30.

Figure 3:
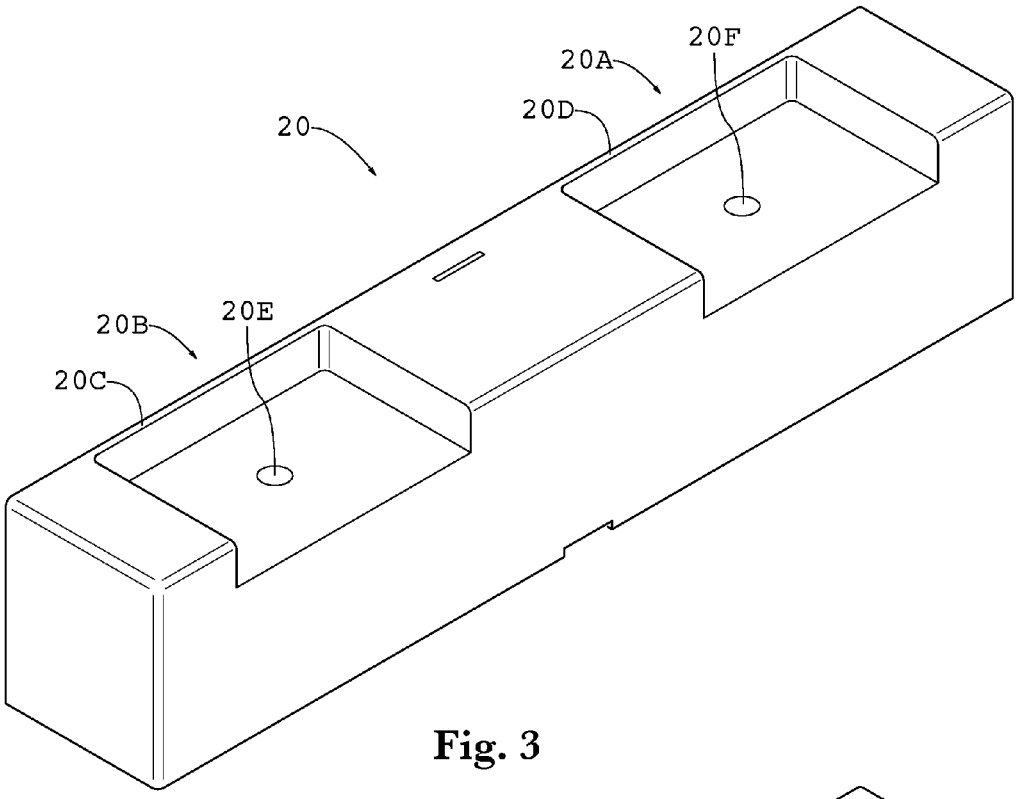
FIG. 3 is a view in perspective illustrating an end runner component of the present invention shown in FIG. 2.
Figure 4:
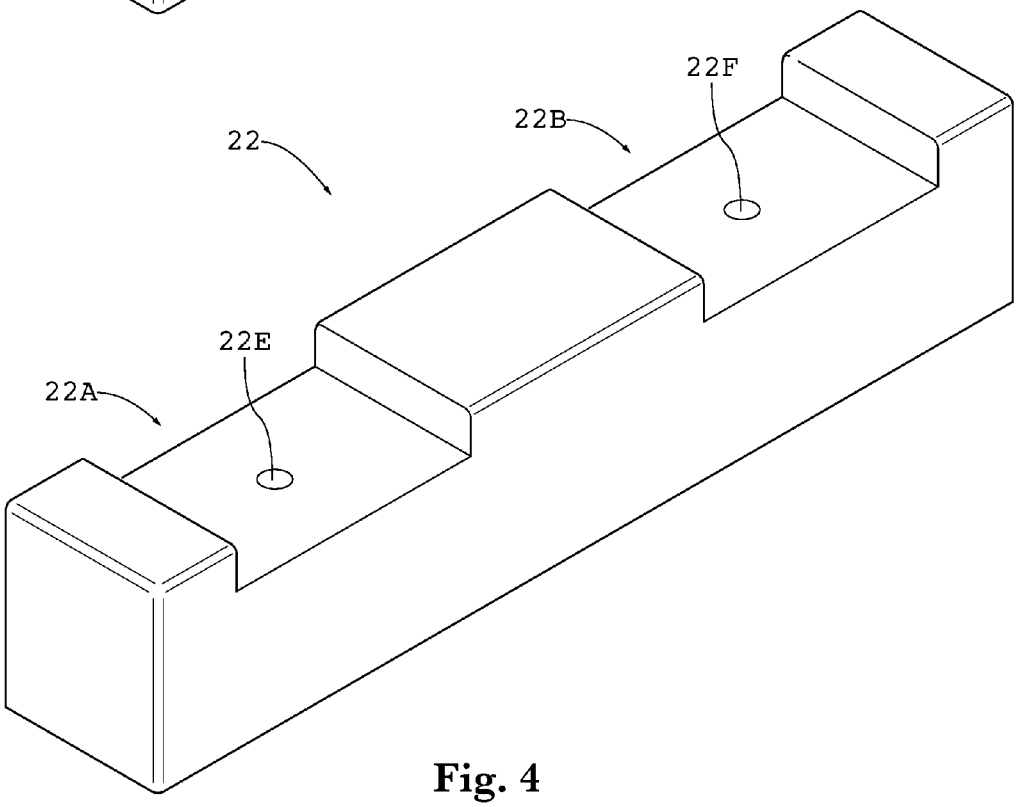
FIG. 4 is a view in perspective illustrating a middle runner component of the present invention shown in FIG. 2.
Figure 5:
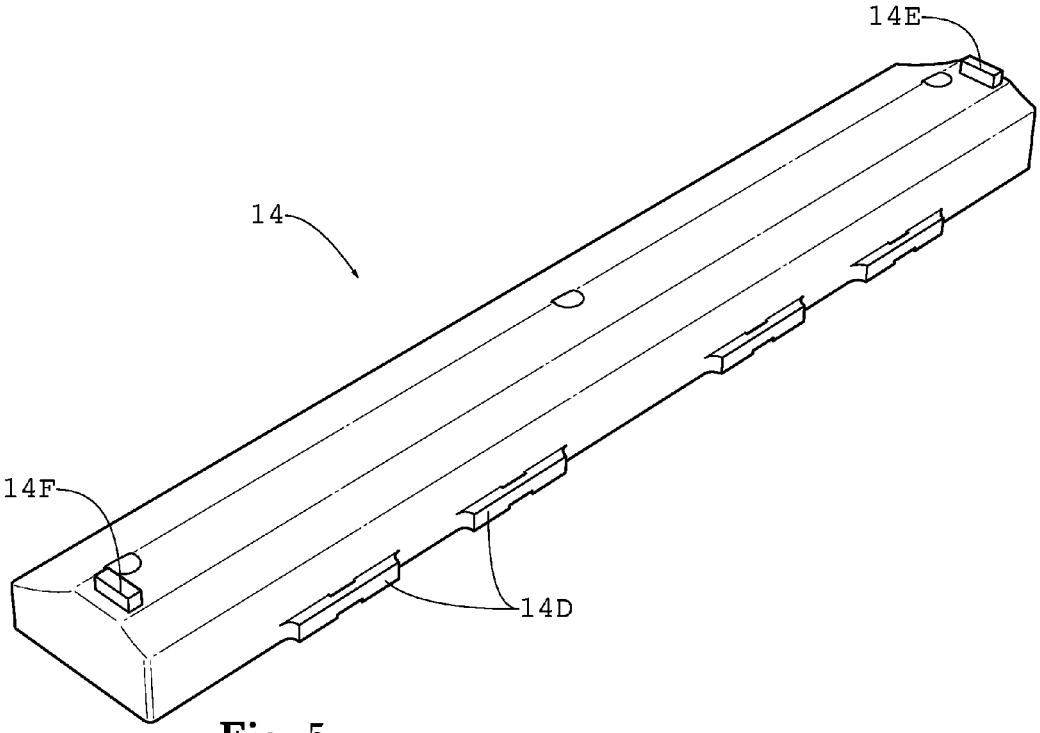
FIG. 5 is a view in perspective illustrating a slat component of the present invention shown in FIG. 2.

The pallet 10 is made up of at least three types of major components, which are shown in FIGS. 3, 4 and 5: end runners, middle runners and slats. Of course, there may be more than one of each component on a given pallet, and the pins 30 are used to connect the major components together to form the completed pallet.

Figure 7:
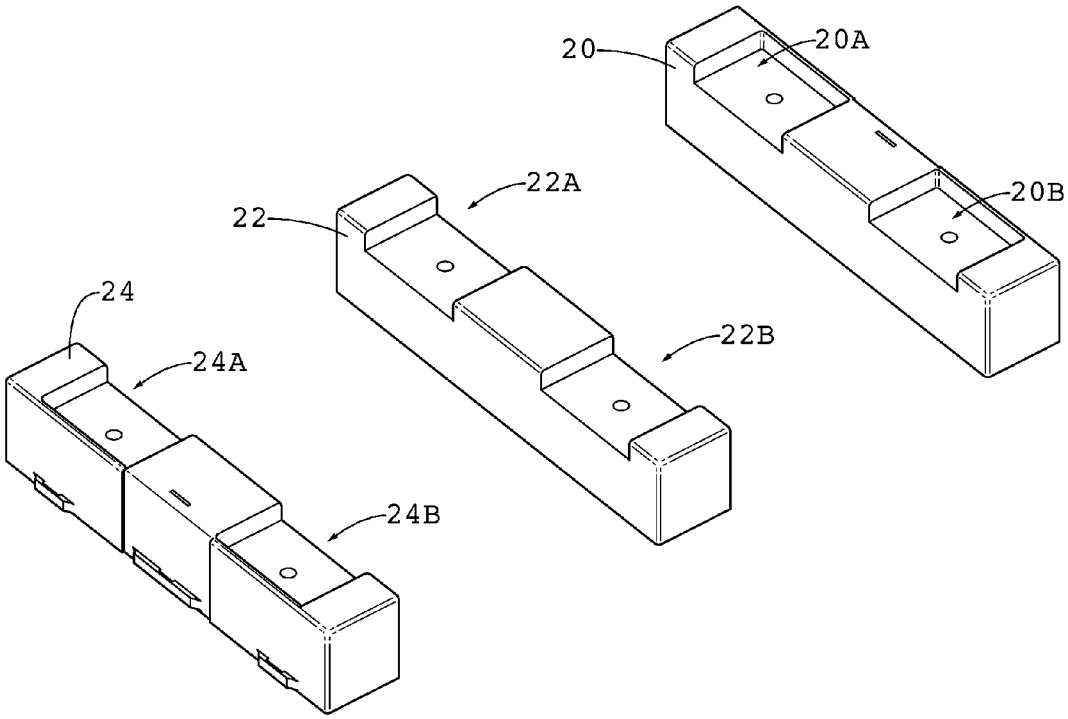
FIG. 7 is a view in perspective illustrating the runner components of the embodiment shown in FIG. 2.

The end runner 20 is the first major component, and is shown in FIG. 3 having two slat grooves 20*a* and 20*b*, each of which has a respective end wall 20*c* and 20*d* and opposing lateral (relative to the orientation of a finished pallet) walls that adjoin the respective end walls. The pin apertures 20*e* and 20*f* are at the ends of bores that extend through the end runner to receive the pins 30, and are centrally located longitudinally of the end runner 20 within the slat grooves 20*a* and 20*b* to permit reversal in the position of the slats 12 and 14 in the grooves as described below. Two preferably identical end runners 20 and 24 are used with the pallet 10, and they are positioned as mirror images of one another on opposite ends of the pallet 10 as shown in FIG. 7. With the first end runner 20 at one end of the pallet 10 and the second end runner 24 positioned at an opposite end of the pallet 10, the end walls 20*c* and 20*d* face corresponding end walls in the end runner 24, as shown in FIG. 7. The slat grooves 20*a* and 20*b* receive the ends of the slats 12 and 14 and the end walls 20*c* and 20*d* protect one of the ends of the slats 12 and 14 from being pried away from the end runner 20, and help position the slats 12 and 14 during construction. The corresponding end walls in the end runner 24 have a similar function to the end walls 20*c* and 20*d* and the slat grooves 24*a* and 24*b* (FIG. 7) receive the slats 12 and 14 in a manner similar to the slat grooves 20*a* and 20*b*.

The middle runner 22 is the second major component of the pallet 10, and is shown in FIG. 4 having two slat grooves 22*a* and 22*b*. The slat grooves 22*a* and 22*b* receive the slats 12 and 14 in a manner similar to the slat grooves 20*a* and 20*b*. The pin apertures 22*e* and 22*f* are at the end of bores that extend into the middle runner and receive the pins 30. The pin apertures 22*e* and 22*f* are centrally located, longitudinally and laterally of the runner 22, within the slat grooves 22*a* and 22*b* to permit reversal in the position of the slats 12 and 14 in the grooves. One middle runner 22 is used with the pallet 10, preferably centrally located at or near the middle of the pallet 10 as shown in FIG. 7, but it is contemplated that for a longer pallet there may be numerous middle runners 22. All runners 20-24 are oriented substantially parallel and spaced from one another in an operable orientation.

Figure 6:
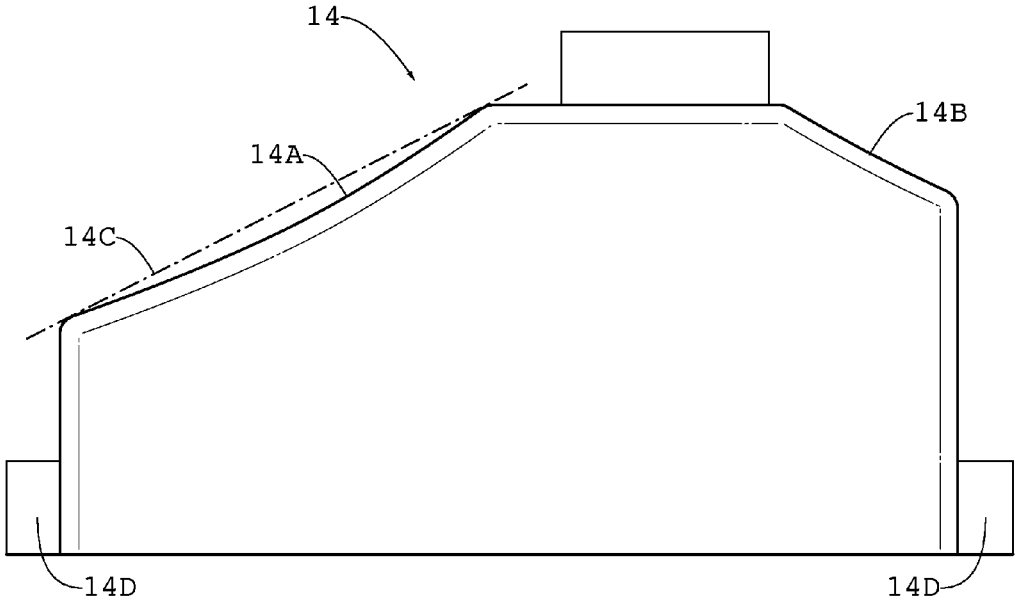
FIG. 6 is an end view illustrating the slat component of FIG. 5.
Figure 22:
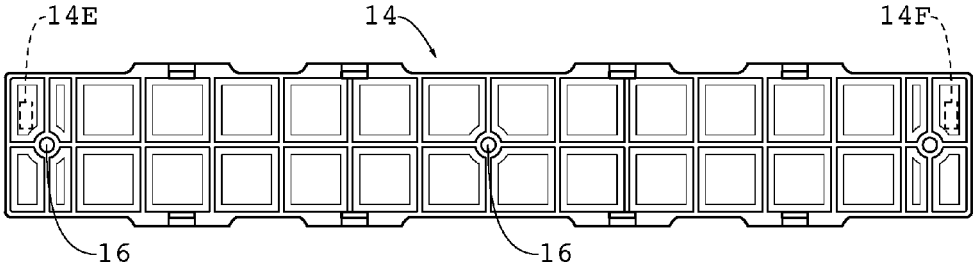
FIG. 22 is a bottom view illustrating a slat.
Figure 23:
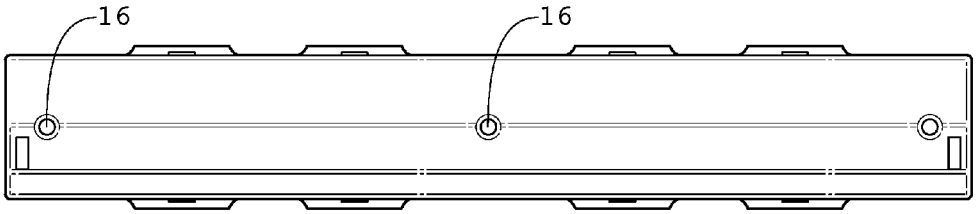
FIG. 23 is a top view illustrating the slat of FIG. 22.
Figure 24:
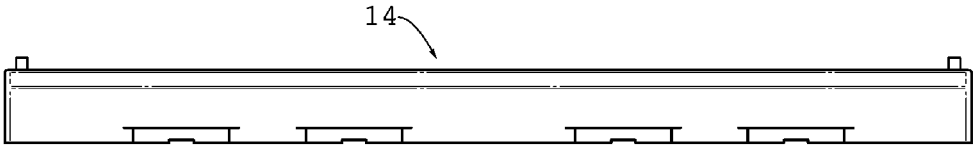
FIG. 24 is a side view illustrating the slat of FIG. 22.
Figure 25:
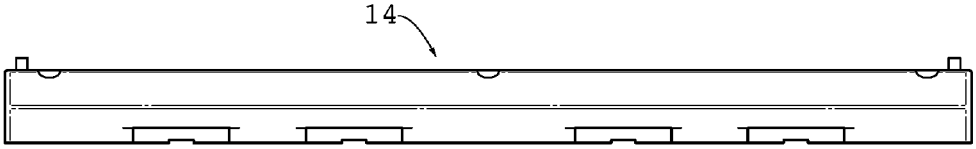
FIG. 25 is an opposite side view illustrating the slat of FIG. 22.

The slat 14 is the third major component of the pallet 10 and is shown in FIG. 5 having angled or curved faces 14*a* and 14*b*. The slat 12 is substantially identical to the slat 14 and therefore is not described in detail herein. The faces 14*a* and 14*b* are preferably curved in the direction from the top toward the bottom, and this can be seen in the end view of the slat 14 shown in FIG. 6. The faces 14*a* and 14*b* are preferably not curved in the longitudinal direction (from one end of the slat 14 to the opposite end). When one compares the face 14*a* to the straight imaginary line 14*c* that is placed adjacent the face 14*a* in FIG. 6, it can be seen that the face 14*a* is concave, and this concavity provides benefits when it receives a convex outer surface of cargo. The face 14*b* is similarly concave, but this is not as visible due to the smaller width of the face 14*b*. Pin apertures 16 are formed in the slats 12 and 14, and are the ends of bores that extend entirely through the slats as shown in FIGS. 22 and 23.

Figure 11:
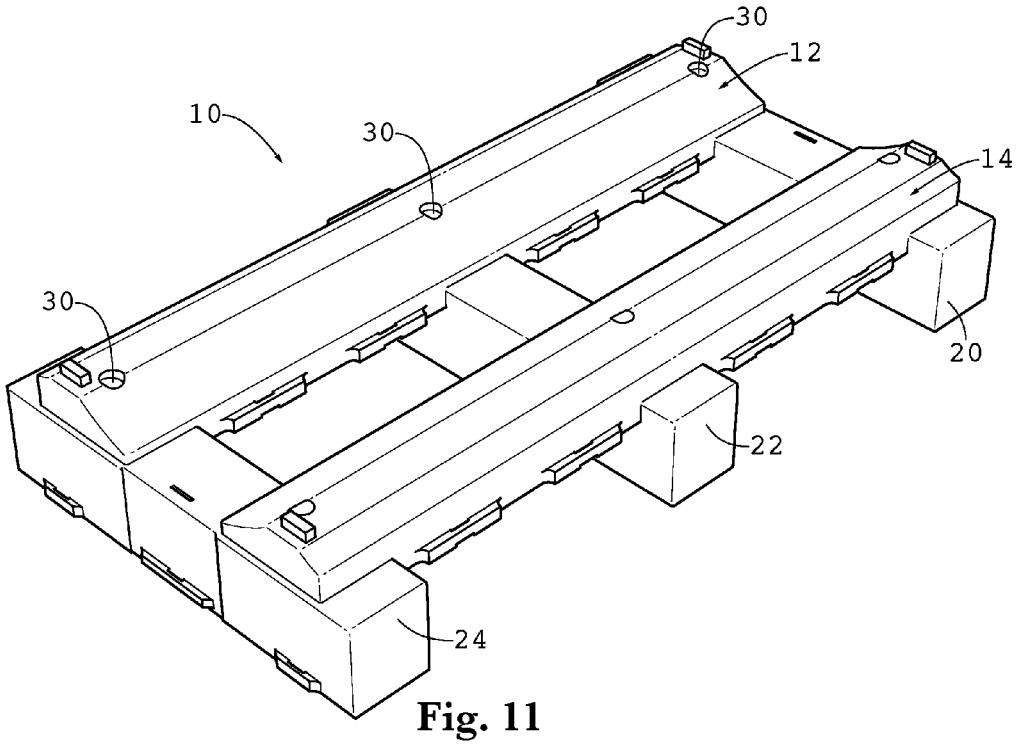
FIG. 11 is a view in perspective illustrating the embodiment of FIG. 2.
Figure 12:
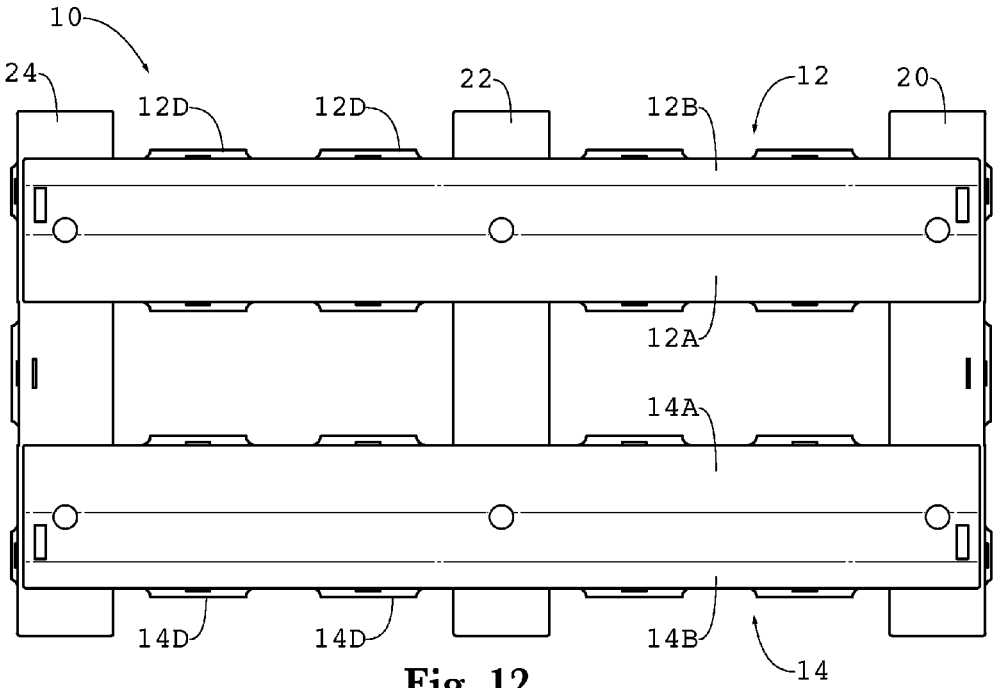
FIG. 12 is a top view illustrating the embodiment of FIG. 2.

As shown in FIG. 5, the slat 14 may have a plurality of U-shaped strap-retainers 14*d* on its sides, which allow conventional cargo straps to be inserted through an aperture formed therein. These strap-retainers 14*d* prevent the straps from sliding lengthwise along the slat 14 (and the slat 12). Nesting guides 14*e* and 14*f* are additional features formed at opposite ends of the slat 14. Nesting guides 14*e* and 14*f* seat within cavities formed on the bottom of identical slats, as shown in FIG. 22 in phantom in the position where they are located, that are stacked one upon the other. Two substantially identical slats 12 and 14 are used on the pallet 10, as shown in FIGS. 11 and 12, and the nesting guides 14*e* and 14*f* assist in nesting if the slats 12 and 14 are stacked in a nesting configuration with one on top of the other. This may be done prior to assembly of the pallet 10.

FIG. 7 shows the runners 20, 22 and 24 aligned in preparation for assembly of the pallet 10. The runners 20-24 are aligned substantially parallel to one another and substantially equally spaced. Note that the end walls of the end runners 20 and 24 are at opposite ends of the pallet 10. The pallet 10 will be assembled as shown and described, and the ends of the slats 12 and 14 are protected by the end walls when the pallet 10 is fully assembled.

Figure 8:
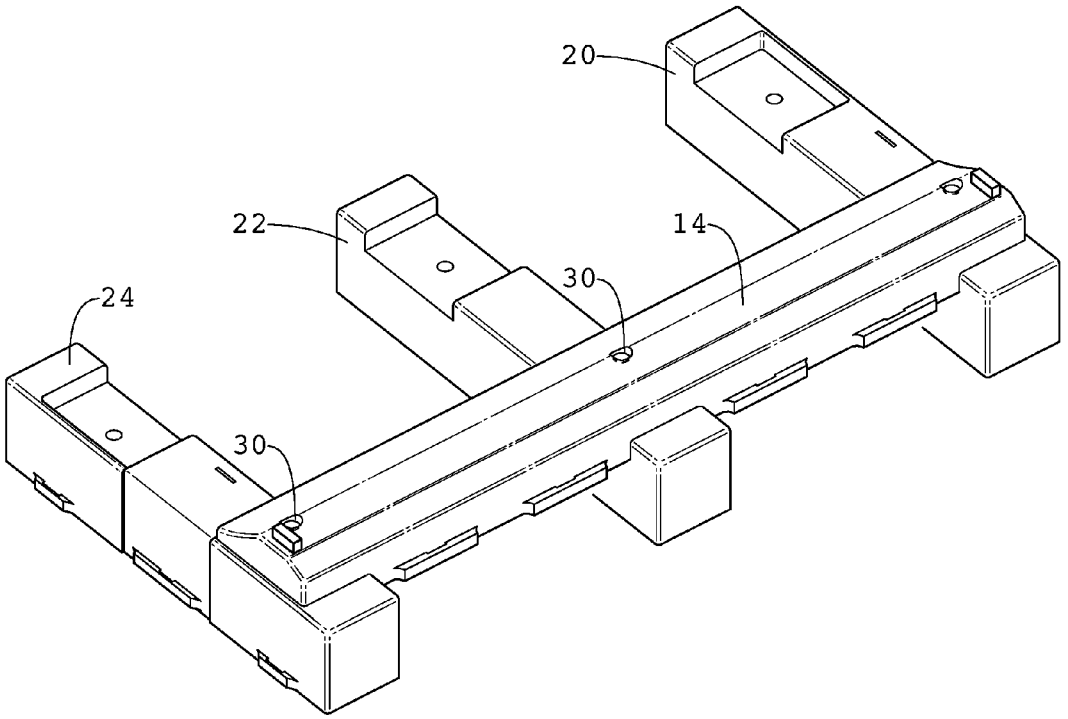
FIG. 8 is a view in perspective illustrating the embodiment of FIG. 2 in a state of partial assembly.
Figure 9:
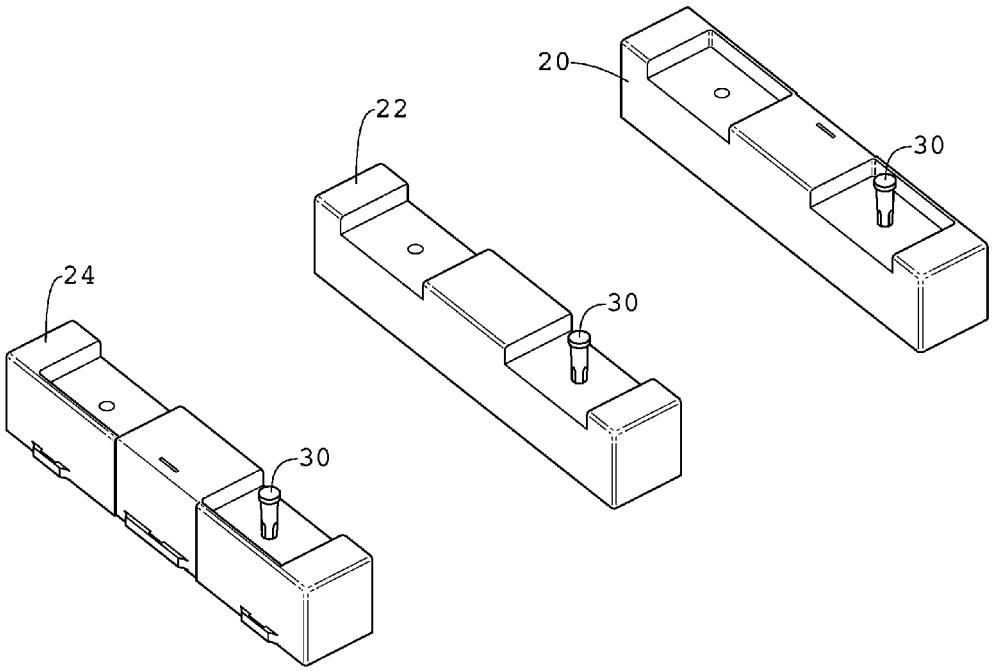
FIG. 9 is a view in perspective illustrating the structures shown in FIG. 7 with the pins mounted as they would be in FIG. 8, but with the slat removed for illustrative purposes.
Figure 10:
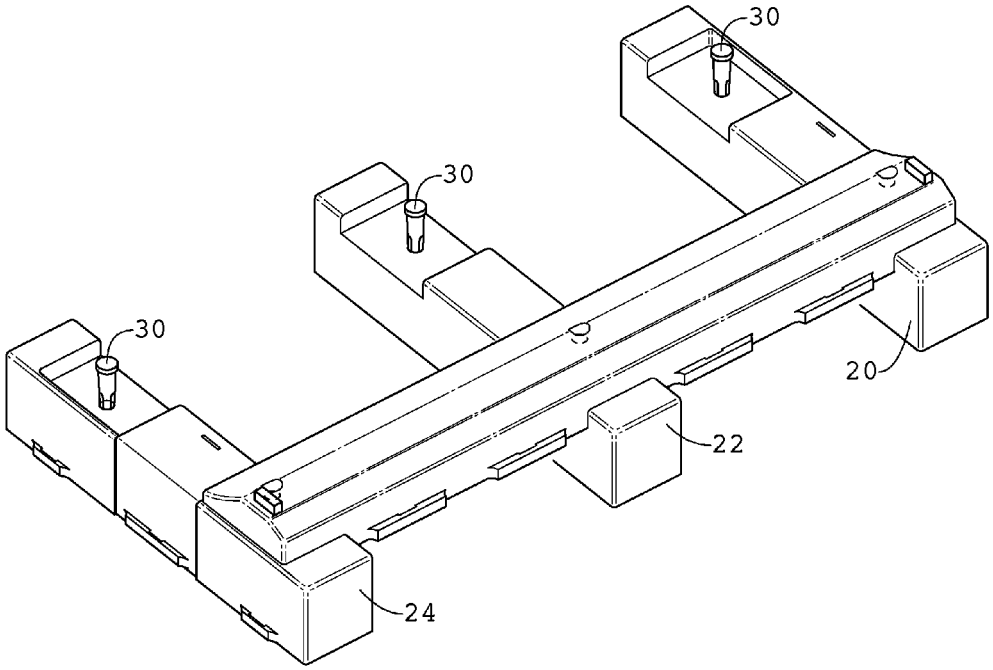
FIG. 10 is a view in perspective illustrating the structures shown in FIG. 8 with the pins mounted as they would be in FIG. 11, but with the slat removed for illustrative purposes.

Once the runners 20-24 are positioned as in FIG. 7, the slat 14 is mounted in the aligned series of slat grooves 20*b*, 22*b* and 24*b* in the runners 20-24 along one longitudinal end of each of the runners 20-24, as shown in FIG. 8, which is the lateral side of the assembled pallet 10. The pins 30 are inserted in the corresponding and aligned apertures 16 on the slat 14 and through the bores in each of the runners 20-24. The location of each of the pins 30 is shown in FIG. 9 (without the slat 14 in place) for illustrative purposes, and the pins 30 are preferably only inserted when a corresponding slat is in place on the runners 20-24. The pins 30 fix the slat 14 to the runners 20-24 in the manner of a bolt. A similar illustration is shown in FIG. 10, in which the pins 30 are shown in the location they will have when the slat 12 is mounted as shown in FIG. 11, but without the slat 12 in position. Again, this is for illustrative purposes only, because the pins 30 are preferably only in the position shown in FIG. 10 when the corresponding slat 12 is in place as shown in FIGS. 11 and 12.

Figure 13:
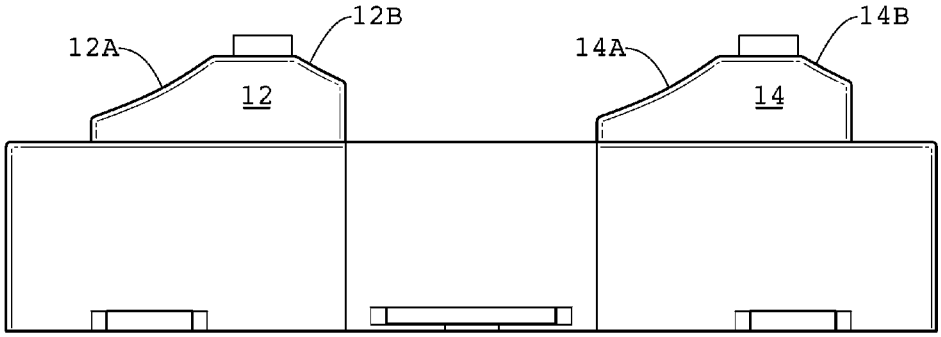
FIG. 13 is an end view illustrating an alternative arrangement of the slats of the embodiment of FIG. 2.
Figure 14:
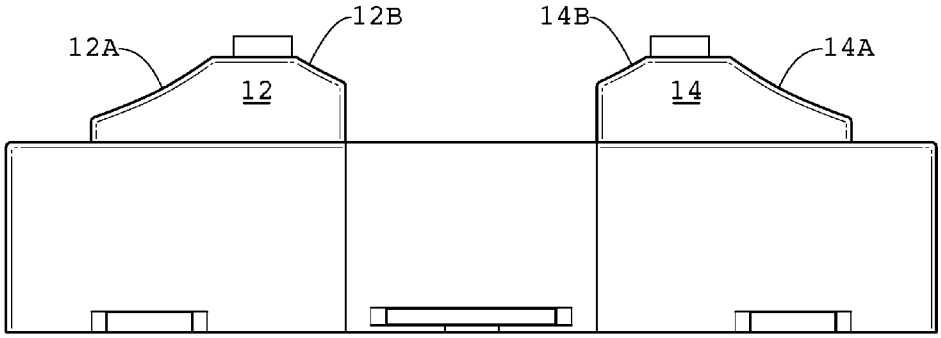
FIG. 14 is an end view illustrating another alternative arrangement of the slats of the embodiment of FIG. 2.
Figure 15:
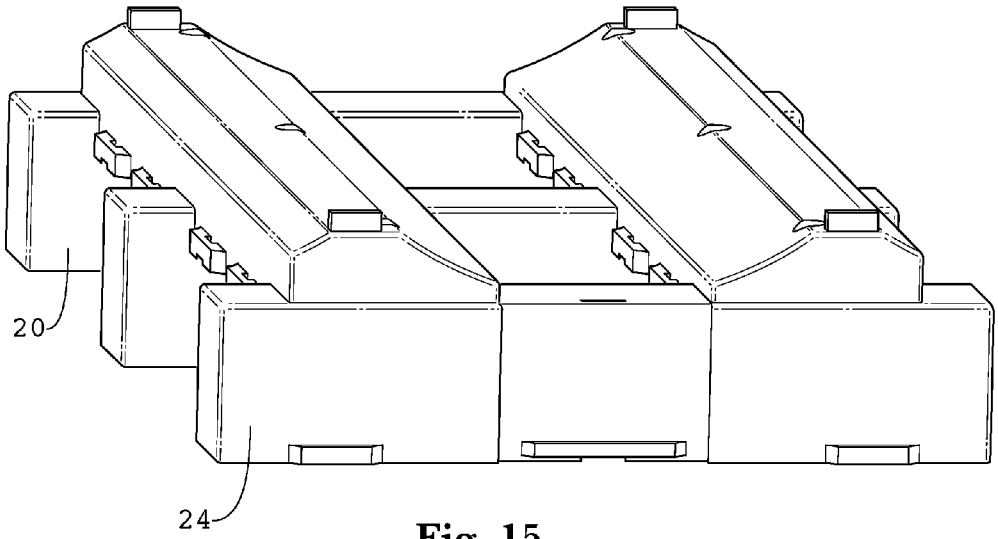
FIG. 15 is an end view in perspective illustrating the embodiment of FIG. 2.

FIGS. 11 and 12 show the slats 12 and 14 mounted with their longer faces 12*a* and 14*a* closest to, and facing, one another. As shown in FIG. 14, the slats 12 and 14 can be mounted with their shorter faces 12*b* and 14*b* facing one another, or in FIG. 13 with one long face 14*a* and one short face 12*b* facing one another. Because the apertures 16 in the slats 12 and 14 align with the apertures 20*e*, 20*f*, 22*e*, 22*f* (and corresponding apertures in the end runner 24), regardless of orientation of the slats 12 and 14 in the slat grooves, the invention has immense flexibility in how it can be constructed. It is an advantage of the present invention that the slats 12 and 14 can be mounted in either orientation in the grooves in the runners 20-24. Because the apertures 20*e*, 20*f*, and others are centrally located within the corresponding slat grooves, the pins 30 can be used to fasten the slats to the runners regardless of the orientation of the slats 12 and 14. This allows the user to best accommodate the shape and size of the cargo placed on the pallet 10 by orienting the slats 12 and 14 to best receive the cargo on their faces. Thus, if any of the configurations shown in FIGS. 12-14 best suits the shape, size or other feature of the cargo, that configuration is used by so arranging or re-arranging the slats 12 and 14.

Figure 16:
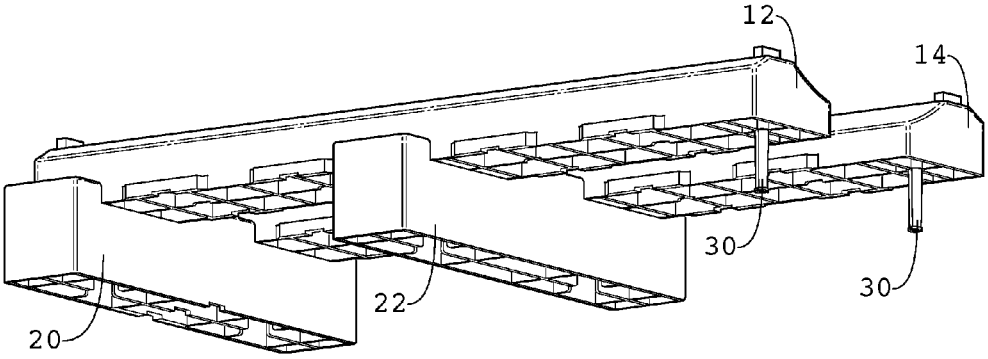
FIG. 16 is a side view in perspective illustrating the embodiment of FIG. 15 with one of the end runners omitted, but with the pins shown as they would be positioned were the missing runner not omitted.

In FIG. 16, the pallet 10 is shown with the end runner 24 removed but with the pins 30 in their location when the runner 24 is in place. This is for illustrative purposes only, and shows the location of the pins 30 when inserted into each of the runners 20-24 after extending through the slats 12 and 14. Preferably the pins 30 would not be installed in the slats in this manner unless the end runner 24 is in place. In a preferred embodiment, the end of each pin with the slot 34*s* is inserted through the aperture 16 in the slat 12 or 14, and then through the aperture 20*e*, 20*f*, etc. in the respective runner. On the bottom of the runner, the aperture's bore terminates above the lowest edge of the runner (see FIG. 21 for illustration of this in a mid-runner) by a distance greater than the thickness of the head 34, thereby allowing the head 34 of the pin 30 to spring open after exiting the aperture but to remain protected so that no part of the pin 30 supports the weight of the pallet 10 or its cargo.

Figure 17:
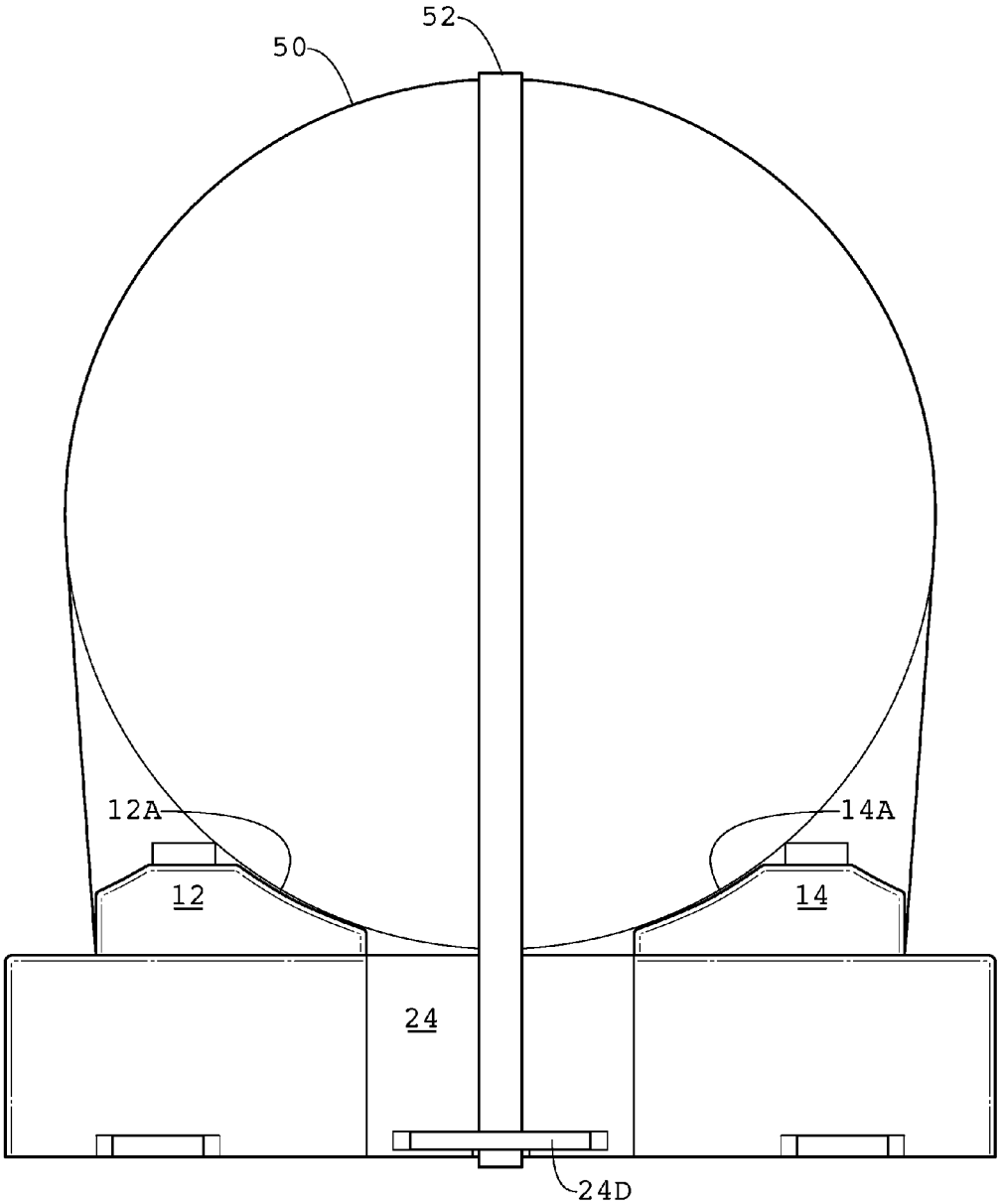
FIG. 17 is an end view illustrating the embodiment of FIG. 2 with cargo mounted thereto.

The pallet 10 has cylindrical cargo 50, which may be a pressure vessel, a metal mold, a container or any other object, resting on the slats 12 and 14, as shown in FIG. 17. The diameter of the cargo 50 is such that it is best nested between the curved faces 12*a* and 14*a* on the slats 12 and 14 in their orientation shown in FIG. 17, which is similar to that shown in FIGS. 2, 11, 12 and 15. For different diameter cargo, one or both of the slats 12 and 14 may be reversed to the positions shown in FIG. 13 or 14 so that the cargo rests against faces 12*b* and 14*a* or 12*b* and 14*b*.

The contemplated pallet 10 thus has slats 12 and 14 with faces that accommodate cargo from between about 14 to 20 inches in diameter, but with modification of the orientation, cargo up to about 24 inches in diameter can be readily accommodated by the same major components. Of course, the runners and slats of any given pallet may be made taller, longer and/or wider, and/or with slat grooves spaced farther apart to accommodate different-sized cargo. The curved faces on the slats can be of varying radius of curvature analogous to a "French curve", in order that one can select a position on the curved faces to rest the cargo.

The cargo 50 is mounted to the pallet 10 by cargo straps 52. The cargo straps preferably extend through the U-shaped strap-retainers 14*d*, 12*d* (see FIG. 12), which are identical to the retainers 14*d* and possibly similar U-shaped strap-retainers (e.g., retainer 24*d* in FIG. 17) mounted to the end runners 20 and 24. The cargo straps 52 may be conventional metal or woven polymer cargo straps.

Figure 18:
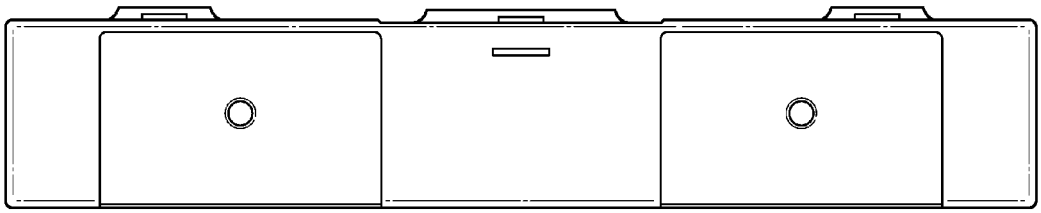
FIG. 18 is a top view illustrating an end runner.
Figure 19:
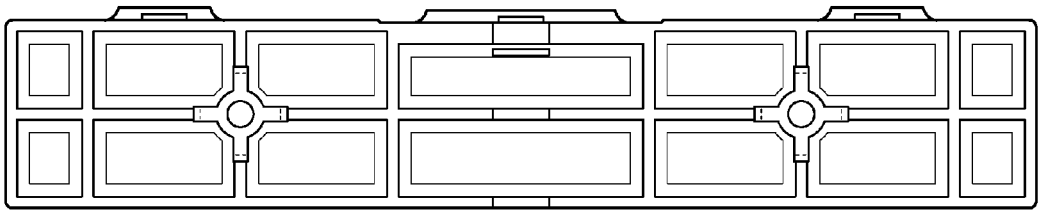
FIG. 19 is a bottom view illustrating the end runner of FIG. 18.
Figure 20:
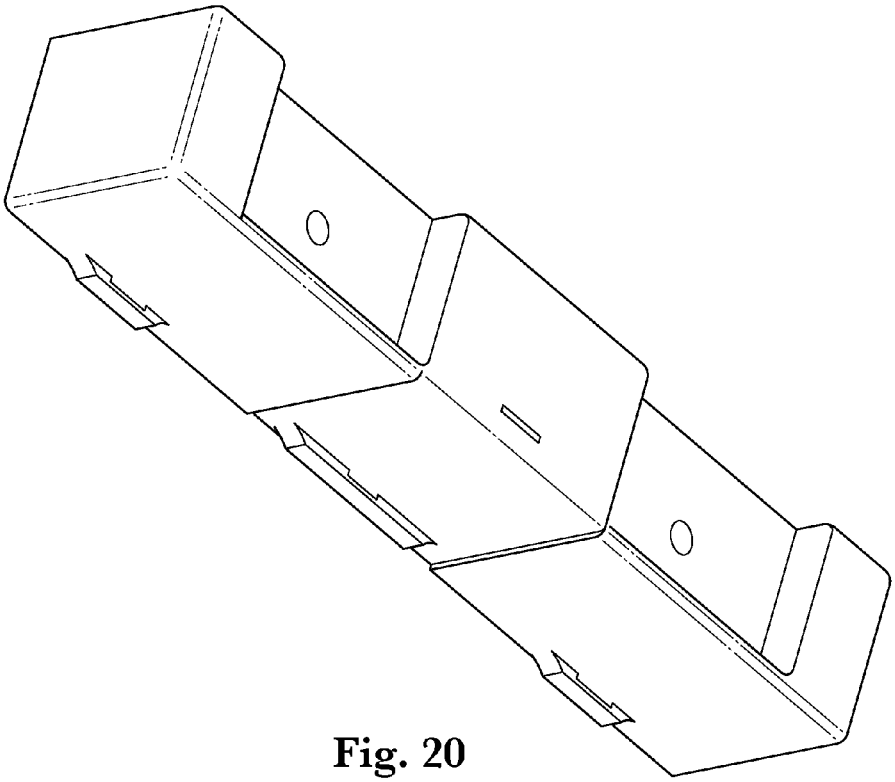
FIG. 20 is a view in perspective illustrating the end runner of FIG. 18.
Figure 21:
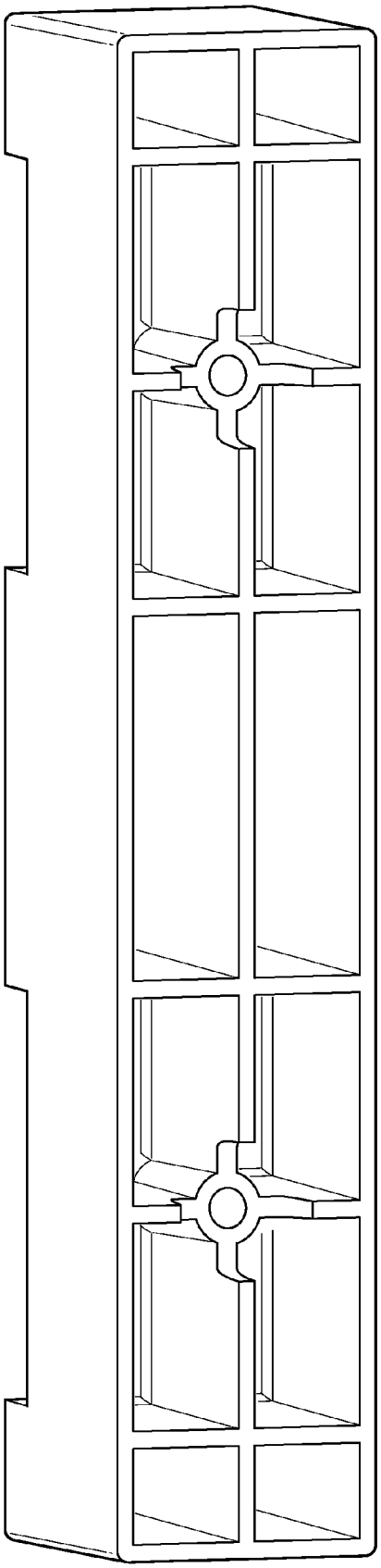
FIG. 21 is a bottom view in perspective illustrating the end runner of FIG. 18.

FIG. 18 shows the end runner 20 from a top view, and FIG. 19 is the same end runner 20 from a bottom view. FIG. 20 is a perspective view of the end runner 20. FIG. 21 is a bottom perspective view of the mid runner 22, which shows where the bores of the pin apertures 22*e* and 22*f* terminate above the lowest point of the runner 22. The bottoms of the end runners 20 and 24 are very similar in at least this regard.

Figure 26:
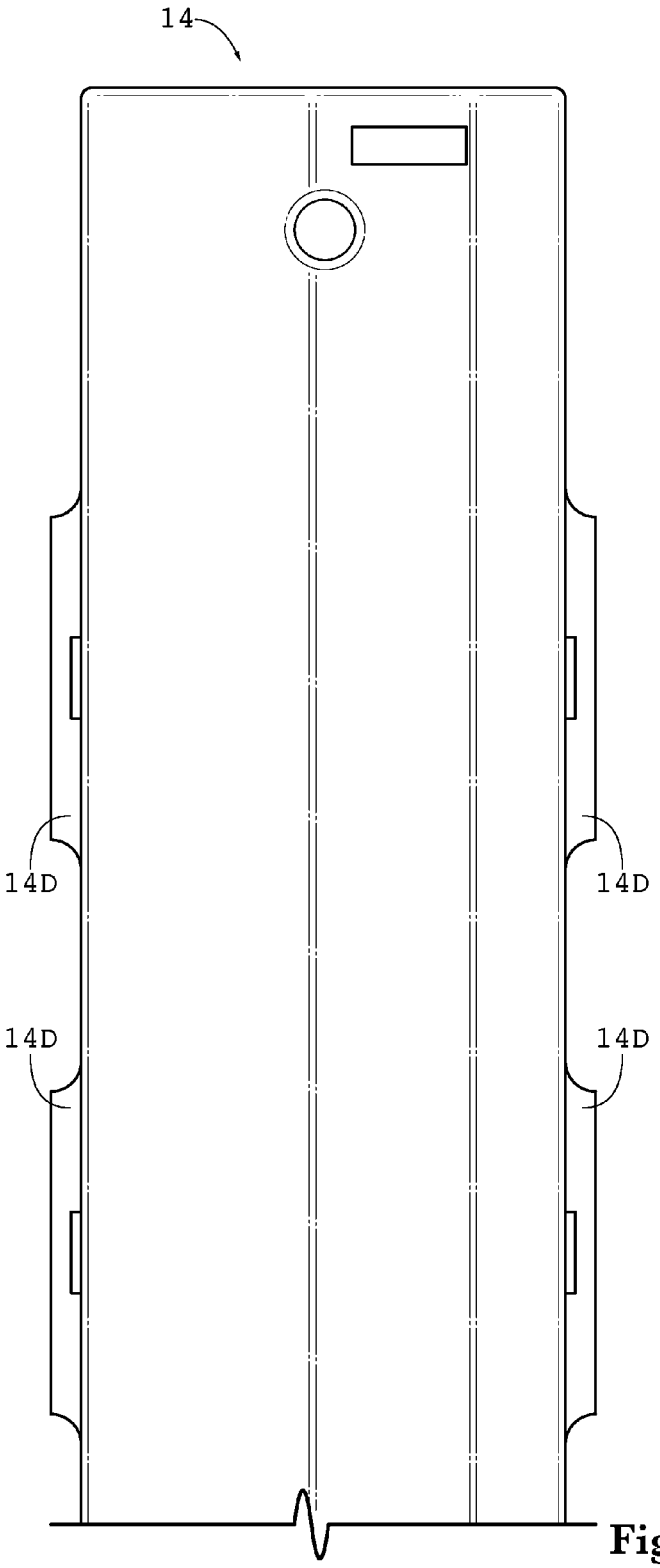
FIG. 26 is a top view illustrating an end of the slat of FIG. 22.
Figure 27:
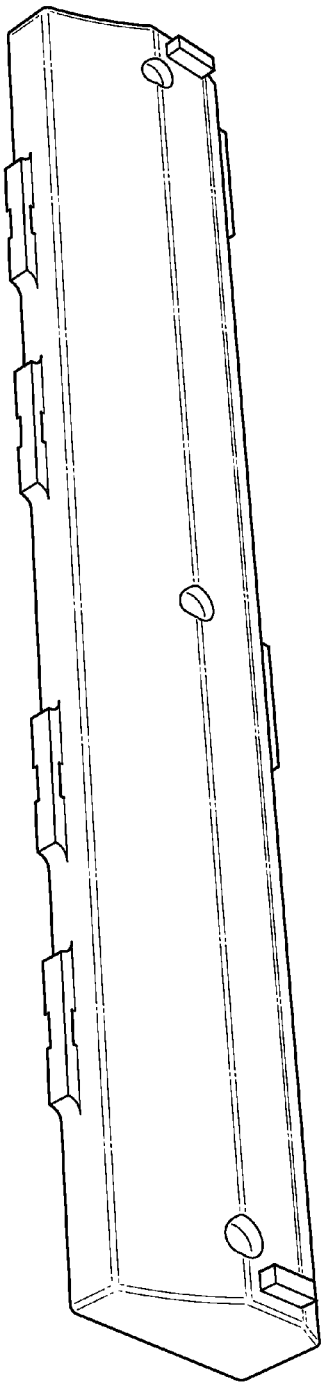
FIG. 27 is a view in perspective illustrating the slat of FIG. 22.
Figure 29:
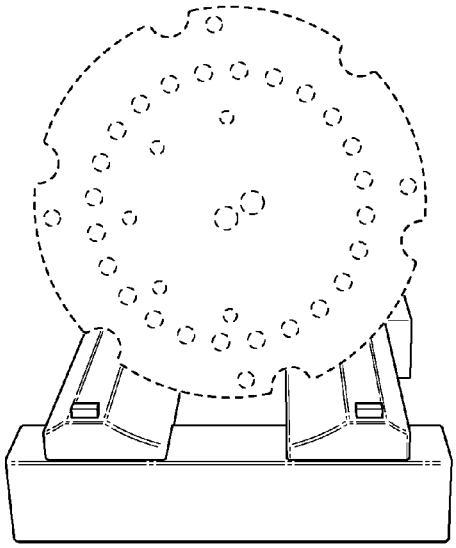
FIG. 29 is a view in perspective illustrating the present invention with cargo mounted thereto.
Figure 30:
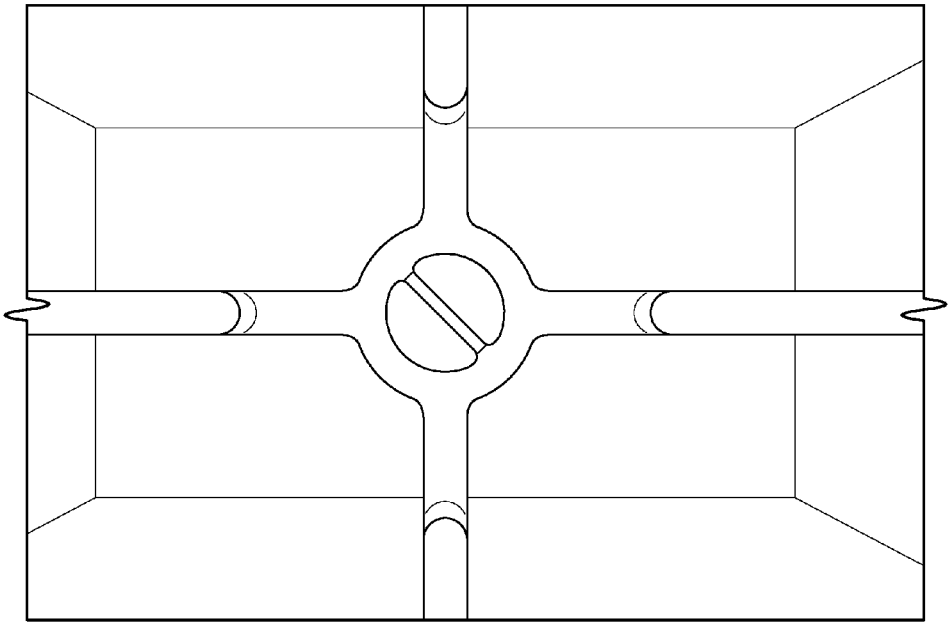
FIG. 30 is a bottom magnified view illustrating a pin end.
Figure 31:
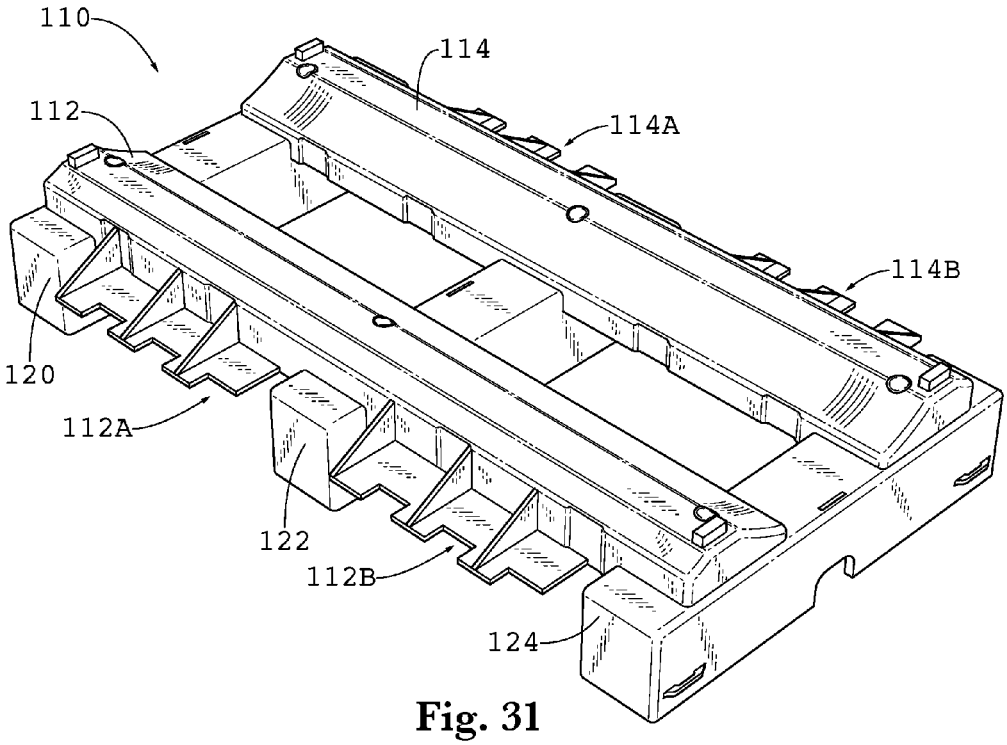
FIG. 31 is a view in perspective illustrating an alternative embodiment of the invention.

FIGS. 22, 23, 24 and 25 show the slat 14 from the bottom, top, short face side and long face side, respectively. FIG. 27 shows the slat 14 from another perspective, and FIG. 26 shows one end of the slat 14 in a more magnified view. FIG. 29 shows a roughly cylindrical object on a pallet made in accordance with the invention. FIG. 30 shows the end of a pin that has expanded after insertion into a runner.

The end walls on the end runners 20 and 24 prevent or greatly reduce the possibility that a slat 12 and 14 may be pried off the pallet 10 during use, whether unintentionally or otherwise. If the fork of a forklift could be inserted between the slats 12 and 14 and the runners 20-24, the fork could pry the slats from the runners. Because of how the slats rest in slat grooves in each of the runners 20-24, it is not likely that a user would unintentionally insert a fork between the slat and the runner from any of the four sides of the pallet 10. This can be seen in FIG. 15 where the end walls of both end runners 20 and 24 cover at least a portion of the ends of the slats 12 and 14, and the lateral sides of the pallet 10 are also not exposed for fork insertion. This prevents access to a horizontal crack between a slat and a runner by a fork on a forklift. Such a fork placed in such a horizontal crack could separate the slats from the end runner, but this is virtually impossible with the normal use of the pallet 10.

Based on the relative sizes of the slats 12 and 14, the slat grooves in the runners 20-24, pins and pin apertures, and the recessed positions of the pin tips, the pins do not bear any of the weight of the cargo. When weight rests on a slat, that weight is transferred to the corresponding runners only, not to any pins. The sizes of the slat grooves are such that if a slat receives a lateral force, the slat cannot be moved far enough laterally relative to an attached runner to place a shear force on a corresponding pin. This may be due to the tight fit of slats in the slat grooves compared to the loose fit of the pins in the apertures, or to any other relationship. Instead, the sidewalls and end walls of the slat grooves stop the movement of the slat before a shear force is applied to a pin. The pins connect the slats and the runners, so that when the cargo is lifted by a forklift's forks under the slats the pins prevent the runners from falling away from the slats.

In the illustrations, a pallet 10 is shown with two slats 12 and 14 and three runners 20-24. It is contemplated that a pallet may be made with more than three runners. For example, a pallet may be constructed with five runners—two end runners and three mid runners—and two much longer slats. The pallet 10 may have an overall width of forty inches and a length of four feet, but the pallet 10 may be made much smaller or much larger than this typical pallet size. There are only practical limits to the number and size of the completed pallet, and this will become apparent to the person of ordinary skill.

The pallet is preferably made of polymer, as noted above, and is cast or injection molded into individual components that are assembled as described herein. Of course, it is contemplated to make the pallet of metal, wood, fiber-reinforced polymer composite, or any other suitable material, as will become apparent to the person of ordinary skill from the description herein, but such materials would present advantages and disadvantages that are known to the person of ordinary skill.

In the embodiment shown in FIG. 17, the pallet 10 is wider than the cargo item 50. In this situation, the forks of the forklift extend under the pallet 10, and the portion of the forklift that extends upwardly from the ends of the forks nearest the lift abuts the lateral edges of the runners 20-24. This prevents the upwardly-extending portion from impacting, and possibly damaging the cargo 50 or the straps holding the cargo 50. An alternative embodiment of the invention is shown in FIGS. 31-36. In the alternative embodiment, the pallet 110 is substantially identical to the pallet 10, but there are blockers 112*a*, 112*b*, 114*a* and 114*b* mounted to at least one side of each of the slats 112 and 114. These blockers 112*a*-114*b* extend outwardly (laterally on a finished pallet) of the runners 120, 122 and 124 for stopping the upwardly-extending portion of the forklift from impacting the cargo. The blockers 112*a*-114*b* are shown attached to the sides of the slats 112 and 114 that have the short faces, but it is contemplated that blockers 112*a*-114*b* may be attached to either side (or both sides) of the slats 112 and 114. The blockers on opposite sides may be of different size or shape.

Figure 32:
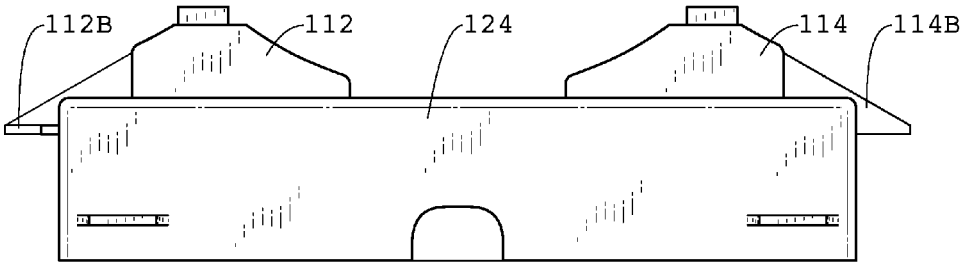
FIG. 32 is an end view illustrating the embodiment of FIG. 31.
Figure 33:
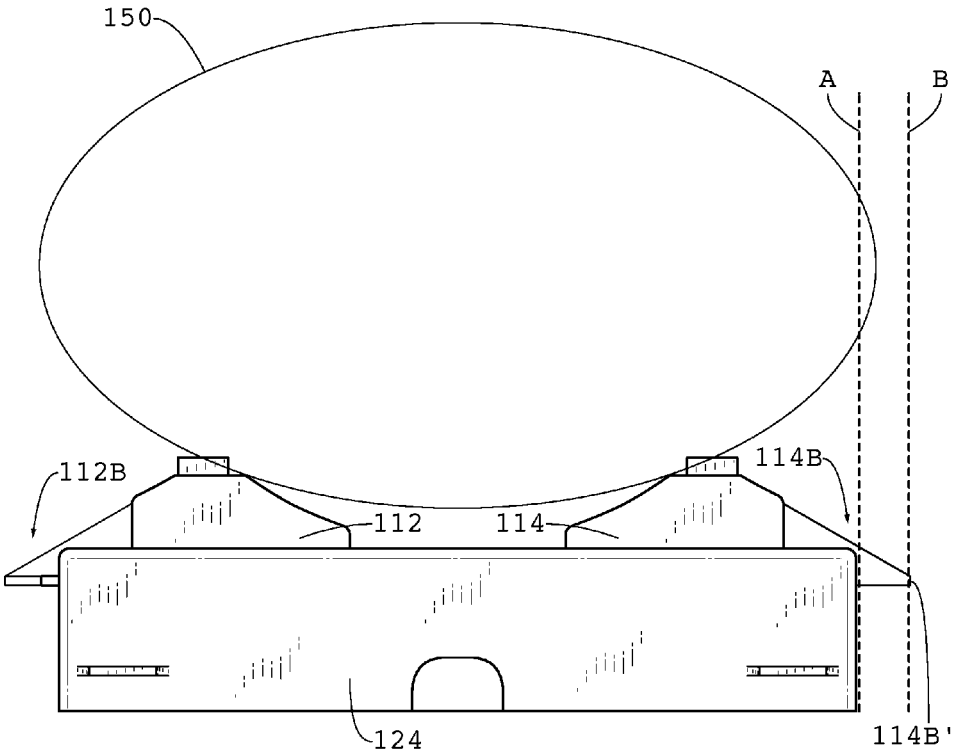
FIG. 33 is an end view illustrating the embodiment of FIG. 31 with cargo shown mounted thereto.
Figure 34:
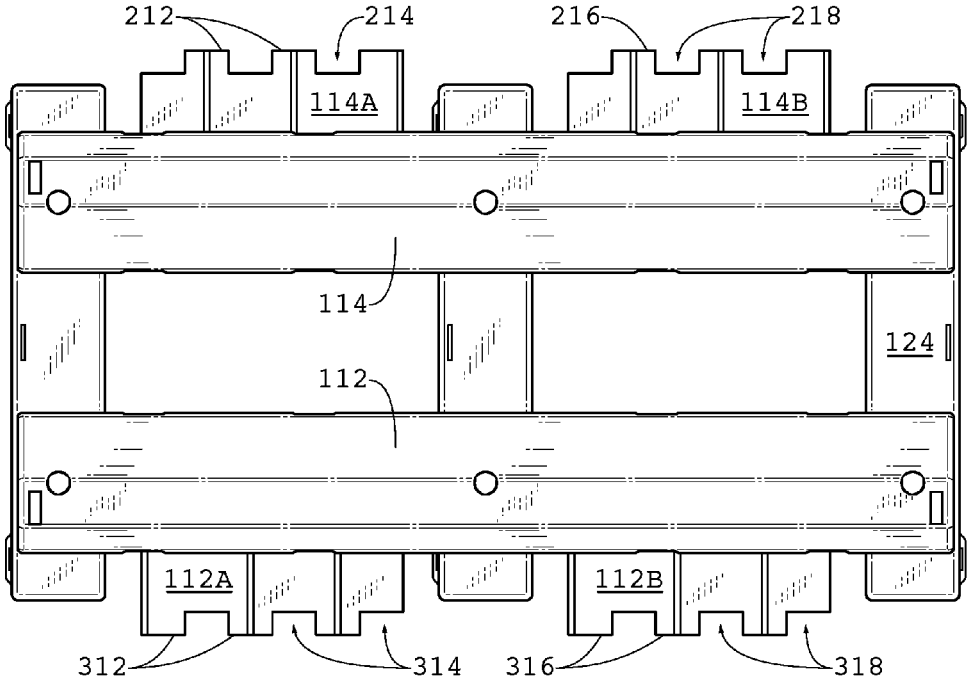
FIG. 34 is a top view illustrating the embodiment of FIG. 31.

As shown in the end view of FIG. 32 and the top view of FIG. 34, the blockers 112*a*-114*b* extend, at their outermost extremity, to beyond the lateral extremity of the pallet 110, which is the longitudinal extremity of the runner 124, and the other runners 120 and 122. The blockers 112*a*-114*b* present a surface against which the upwardly-extending portion of the forklift may seat during use, rather than seating against the cargo 150 that extends beyond the extremities of the pallet 110 as shown in FIG. 33. The imaginary line A extends parallel to the plane of the end of the runner 124, and the imaginary line B extends parallel to the line A at the outermost extremity, or the tip 114*b*', of the blocker 114*b*. It is apparent that if the forklift were only to be stopped by the end runner 124, and the corresponding ends of the runners 120 and 122, the upwardly-extending portion of the forklift could impact the cargo before impacting the runners 120-124. However, because the tip 114*b*' of the blocker 114*b* extends laterally beyond the ends of the runners 120-124, the upwardly-extending portion of the forklift would only impact the tip 114*b*' of the blocker 114*b*, which is at line B.

Figure 35:
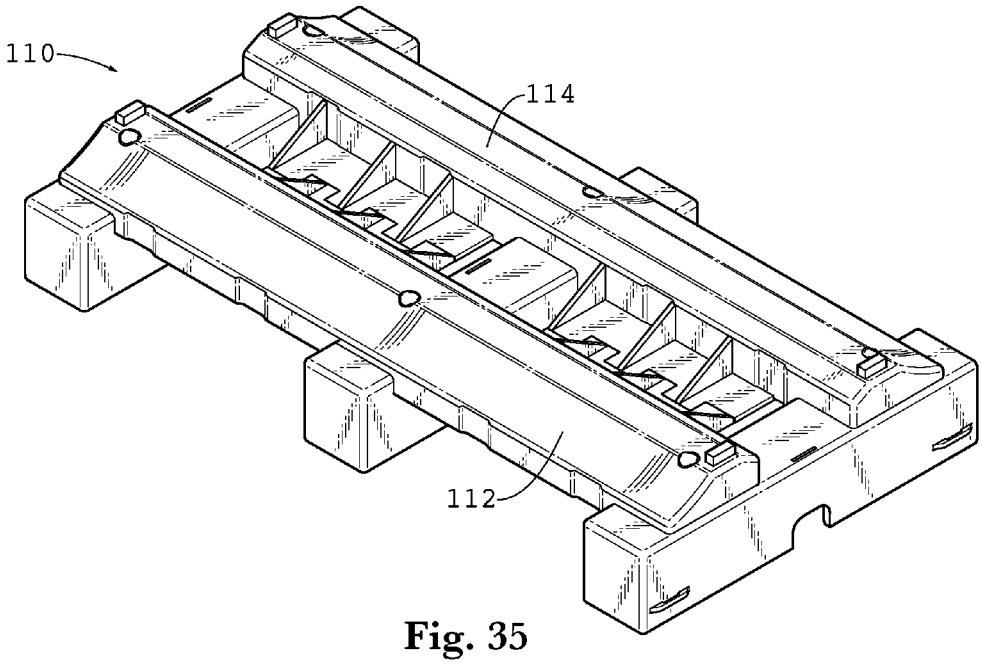
FIG. 35 is a view in perspective illustrating the embodiment of FIG. 31 in an alternative configuration.
Figure 36:
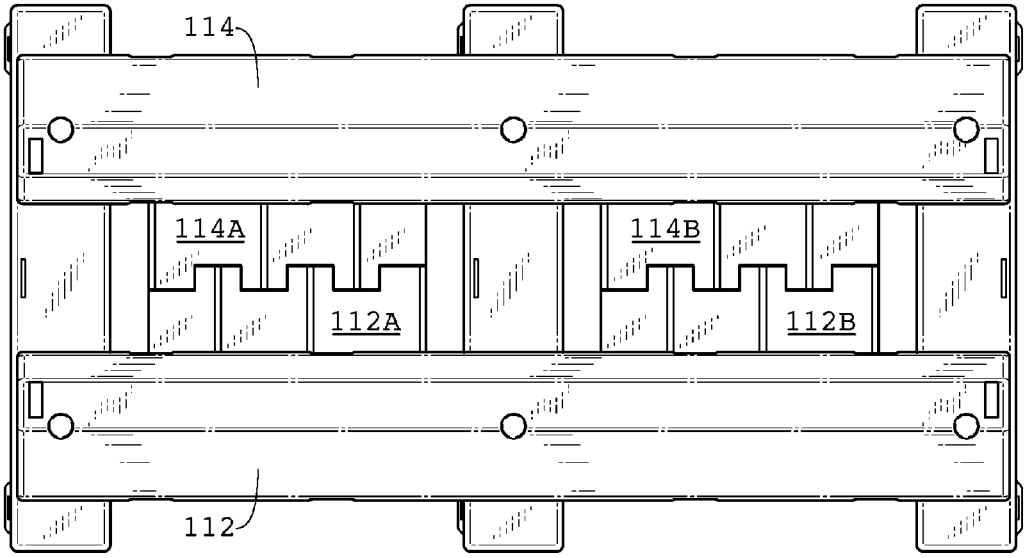
FIG. 36 is a top view illustrating the embodiment of FIG. 31 in the alternative configuration shown in FIG. 35.

There may be times when the blockers 112*a*-114*b* are not needed, or are a hindrance to the use of the pallet 110, and in those situations the slats 112 and 114 may be reversed to the positions shown in FIGS. 35 and 36. In the position shown, the blockers 112*a*-114*b* extend inwardly toward one another, because the slats 112 and 14 have been oriented 180 degrees from the positions shown in FIGS. 31-34. The blockers 112*a*-114*b* preferably have tips that are formed with an interlacing structure, thereby permitting the tips to extend as far as is desired from the slats 112 and 114, but still fitting with the space allowed between one another when reversed. As an example, if the blockers 112*a*-114*b* were each 7 inches long to extend a desired distance from the slats 112 and 114, but only a 12 inch wide gap was formed between the slats 112 and 114, there would be insufficient space for the blockers 112*a*-114*b* to be reversed to face one another if the tips thereof were straight. However, by forming the shown and described interlacing structure, at least some portions of the blockers 112*a*-114*b* extend the desired distance, and other portions extend far less. When the blockers 112*a*-114*b* are thus interlaced as shown in FIGS. 35 and 36, there is sufficient space for blockers to face one another.

The above interlacing structure is shown and described herein, in one example, with peaks 212, 216, 312 and 316 and valleys 214, 218, 314 and 318 on the blockers 112*a*-114*b* shown in FIG. 34. The peaks 212, 216, 312 and 316 extend away from the slats 112 and 114 substantially farther than the valleys 214, 218, 314 and 318. Furthermore, the valleys 214, 218, 314 and 318 are voids that receive the peaks 212, 216, 312 and 316 when the blockers 112*a*-114*b* face one another as shown in FIGS. 35 and 36. Thus, the longer the peaks 212, 216, 312 and 316 are, the deeper the valleys 214, 218, 314 and 318 need to be. Of course, other alternative structures may be used in place of the example shown herein, as will become apparent to a person having ordinary skill, including blockers (not shown) that extend one length from one side of a slat, and separate blockers that extend a different length from the opposite side of the same slat.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A pallet for carrying cargo, the pallet comprising:

(a) a first runner;

(b) a second runner spaced from, and substantially parallel to, the first runner;

(c) a first slat removably mounted to the first and second runners, wherein the first slat has a first cargo-supporting face on a first side and a second cargo-supporting face on an opposite, second side; and (d) a second slat removably mounted to the at least first and second runners with a gap between the first and second slats, wherein the second slat has a first cargo-supporting face on a first side and a second cargo-supporting face on an opposite, second side;

wherein, when the slats are mounted to the runners with the slats' first faces facing one another, the slats' first faces form a first pair of cargo-receiving surfaces, and when the slats are mounted to the runners with the slats' second faces facing one another, the slats' second faces form a second pair of cargo-receiving surfaces, and wherein the first pair of cargo-receiving surfaces contacts the cargo differently than the second pair of cargo-receiving surfaces.

2. The pallet in accordance with claim 1, further comprising a third runner spaced from, and substantially parallel to, the first and second runners and to which the first and second slats are mounted.

3. The pallet in accordance with claim 2, wherein the runners have slat grooves formed therein to receive contacting portions of the slats.

4. The pallet in accordance with claim 3, further comprising protective endwalls formed in the slat grooves formed in the first and third runners, wherein the endwalls extend over at least a portion of the first and second slats' ends.

5. The pallet in accordance with claim 3, further comprising removable pins extending through aligned apertures formed through the first and second slats and through the slat grooves formed in the first, second and third runners.

6. The pallet in accordance with claim 5, wherein each of the pins has a first head at a first end of a narrower shaft and a second head at an opposite, second end of the shaft, and a slot formed in the first head that permits the first head to compress.

7. The pallet in accordance with claim 5, wherein the apertures formed through the first and second slats and through the slat grooves formed in the first, second and third runners are centrally disposed in the slats and the slat grooves, whereby the slats can be positioned in the slat grooves in either of two orientations and the apertures in the slats will align with corresponding apertures in the runners.

8. The pallet in accordance with claim 7, wherein the slats are substantially identical to one another.

9. The pallet in accordance with claim 1, wherein at least the first slat has a first blocker extending laterally therefrom.

10. The pallet in accordance with claim 9, wherein the second slat has a second blocker extending laterally therefrom.

11. A pallet for carrying cargo, the pallet comprising:

(a) a first runner;

(b) a second runner spaced from, and substantially parallel to, the first runner;

(c) a first slat removably mounted to the first and second runners, wherein the first slat has a first cargo-supporting face on a first side and a second cargo-supporting face on an opposite, second side; and (d) a second slat removably mounted to the at least first and second runners with a gap between the first and second slats, wherein the second slat has a first cargo-supporting face on a first side and a second cargo-supporting face on an opposite, second side;

wherein, when the slats are mounted to the runners with the slats' first faces facing one another, the slats' first faces form a first pair of cargo-receiving surfaces, and when the slats are mounted to the runners with the slats' second faces facing one another, the slats' second faces form a second pair of cargo-receiving surfaces, and wherein the first pair of cargo-receiving surfaces contacts the cargo differently than the second pair of cargo-receiving surfaces, wherein at least the first slat has a first blocker extending laterally therefrom, the second slat has a second blocker extending laterally therefrom, and the first and second blockers have peaks and valleys that, when the blockers face one another, interlace to accommodate the length of the blockers.

12. A pallet for carrying cargo, the pallet comprising:

(a) a first runner;

(b) a second runner spaced from, and substantially parallel to, the first runner;

(c) a third runner spaced from, and substantially parallel to, the first and second runners;

(d) a first elongated slat removably mounted to the first, second and third runners in a first series of aligned slat grooves formed in the first, second and third runners, wherein the first slat has a first cargo-supporting face on a first side and a second cargo-supporting face on an opposite, second side; and (d) a second elongated slat removably mounted, with a gap between the first and second slats, to the first, second and third runners in a second series of aligned slat grooves formed in the first, second and third runners, wherein the second slat has a first cargo-supporting face on a first side and a second cargo-supporting face on an opposite, second side;

wherein, when the slats are mounted to the runners with the slats' first faces facing one another, the slats' first faces combine to form a first cargo-receiving shape, and when the slats are mounted to the runners with the slats' second faces facing one another, the slats' second faces combine to form a second cargo-receiving shape, and wherein the first cargo-receiving shape is different from the second cargo-receiving shape.

13. The pallet in accordance with claim 12, further comprising protective endwalls formed in the grooves formed in the first and third runners, wherein the endwalls extend over at least a portion of the slats' ends.

14. The pallet in accordance with claim 12, further comprising removable pins extending through aligned apertures in the at least first and second slats and the at least first, second and third runners.

15. The pallet in accordance with claim 14, wherein each of the pins has first and second heads at opposing first and second ends, respectively, a narrower shaft connecting the first and second heads, and a slot formed in the first head that permits the first head to compress.

16. A combination pallet and cargo, the cargo having an outer surface, the combination comprising:

(a) a first runner;

(b) a second runner spaced from, and substantially parallel to, the first runner;

(c) a third runner spaced from, and substantially parallel to, the first and second runners;

(d) a first elongated slat removably mounted to the first, second and third runners in a first series of aligned slat grooves formed in the first, second and third runners, wherein the first slat has a first cargo-supporting face on a first side and a second cargo-supporting face on an opposite, second side; and (d) a second elongated slat removably mounted, with a gap between the first and second slats, to the first, second and third runners in a second series of aligned slat grooves formed in the first, second and third runners, wherein the second slat has a first cargo-supporting face on a first side and a second cargo-supporting face on an opposite, second side;

wherein the slats are removably and reversibly mounted to the runners with the slats' first faces facing one another and seating against the cargo at two points on the cargo's outer surface, wherein if the slats are mounted to the runners with the slats' second faces facing one another, the slats' second faces seat against the cargo at two points on the cargo's outer surface that are different.

17. The pallet in accordance with claim 16, further comprising protective endwalls formed in the grooves formed in the first and third runners, wherein the endwalls extend over at least a portion of the slats' ends to reduce exposure of the joint between the slats' ends and the runners.

18. The pallet in accordance with claim 16, further comprising removable pins extending through aligned apertures in the slats and the runners.

19. The pallet in accordance with claim 18, wherein each of the pins has first and second heads at opposing first and second ends, respectively, a narrower shaft connecting the first and second heads, and a slot formed in the first head that permits the first head to compress.

20. A method of constructing a pallet to support cargo having an outer surface, the method comprising:

(a) disposing a pallet comprising:

(i) a first runner, a second runner spaced from, and substantially parallel to, the first runner, and a third runner spaced from, and substantially parallel to, the first and second runners;

(ii) a first elongated slat removably mounted to the runners in a first series of aligned slat grooves formed in the runners, wherein the first slat has a first cargo-supporting face on a first side and a second cargo-supporting face on an opposite, second side; and (iii) a second elongated slat removably mounted, with a gap between the slats, to the runners in a second series of aligned slat grooves formed in the runners, wherein the second slat has a first cargo-supporting face on a first side and a second cargo-supporting face on an opposite, second side, and wherein the first cargo-supporting face of the first slat faces the first cargo-supporting face of the second slat;

(b) removing at least the first of the slats from the runners and mounting said at least the first of the slats to the runners in the slat grooves with the second cargo-supporting face of the first slat facing the second slat.

* * * * *